US010385676B2

(12) United States Patent
Parks et al.

(10) Patent No.: US 10,385,676 B2
(45) Date of Patent: Aug. 20, 2019

(54) NON-PARTING TOOL FOR USE IN SUBMERSIBLE PUMP SYSTEM

(71) Applicant: Halliburton Energy Services, Inc., Houston, TX (US)

(72) Inventors: Kenneth W. Parks, Perkins, OK (US); Jimmy D. Hardee, Moore, OK (US); Woodrow W. Byrd, Edmond, OK (US); Stewart Darold Reed, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 180 days.

(21) Appl. No.: 15/508,048

(22) PCT Filed: Dec. 31, 2014

(86) PCT No.: PCT/US2014/072958
§ 371 (c)(1),
(2) Date: Mar. 1, 2017

(87) PCT Pub. No.: WO2016/108876
PCT Pub. Date: Jul. 7, 2016

(65) Prior Publication Data

US 2017/0248001 A1 Aug. 31, 2017

(51) Int. Cl.
*E21B 41/00* (2006.01)
*E21B 44/10* (2006.01)
(Continued)

(52) U.S. Cl.
CPC ..... *E21B 44/10* (2013.01); *E21B 43/128* (2013.01); *F04D 13/10* (2013.01); *F04D 29/041* (2013.01); *F04D 29/043* (2013.01); *E21B 41/00* (2013.01)

(58) Field of Classification Search
CPC ..... E21B 43/128
See application file for complete search history.

(56) References Cited

U.S. PATENT DOCUMENTS 3,462,902 A * 8/1969 Albrecht ..... E04B 5/40 52/336
4,726,422 A * 2/1988 Helderle ..... E21B 23/04 166/122

(Continued)

FOREIGN PATENT DOCUMENTS

WO 02-10551 A1 2/2002
WO 2014140658 A1 9/2014

OTHER PUBLICATIONS

International Search Report and Written Opinion issued in corresponding PCT application No. PCT/US2014/072958, dated Sep. 18, 2015, 11 pgs.

(Continued)

*Primary Examiner* — William D Hutton, Jr.
*Assistant Examiner* — Steven A MacDonald
(74) *Attorney, Agent, or Firm* — Chamberlain Hrdlicka

(57) ABSTRACT

Configurations of tools, e.g., as used in the tool strings of electrical submersible pump systems, that prevent the separation of the tool string into two disconnected units upon breaking of a tool within the tool string. In an example configuration, such a non-parting tool includes a head and base connected to each other via a housing and a shaft extending through the tool, as well as mechanical stops affixed to the shaft that limit, upon breaking of the housing, the relative motion between the head and base.

17 Claims, 4 Drawing Sheets

(51) Int. Cl.

| | |
|---|---|
| ***F04D 13/10*** | (2006.01) |
| ***F04D 29/041*** | (2006.01) |
| ***E21B 43/12*** | (2006.01) |
| ***F04D 29/043*** | (2006.01) |

(56) References Cited

U.S. PATENT DOCUMENTS

| | | | | |
|---|---|---|---|---|
| 5,688,067 | A | 11/1997 | Straub | |
| 5,746,582 | A | 5/1998 | Patterson | |
| 5,871,051 | A | 2/1999 | Mann | |
| 5,947,198 | A | 9/1999 | McKee et al. | |
| 6,283,211 | B1 | 9/2001 | Vloedman | |
| 6,561,775 | B1 | 5/2003 | Wefers | |
| 6,883,604 | B2 | 4/2005 | Mack et al. | |
| 6,926,504 | B2 | 8/2005 | Howard | |
| 7,748,449 | B2 | 7/2010 | Bussear et al. | |
| 2007/0215343 | A1* | 9/2007 | McDonald | E21B 4/006 166/105 |
| 2013/0062050 | A1 | 3/2013 | Head | |
| 2014/0079574 | A1* | 3/2014 | Brunner | F16D 1/08 417/423.3 |
| 2015/0064034 | A1* | 3/2015 | Davis | E21B 43/128 417/423.9 |

OTHER PUBLICATIONS

Bratthall, J., "Mechanical Seals for Abrasive and Clogging Media," Retreived on Jan. 24, 2017 from http://link.springer.com/chapter/10.1007/978-94-011-2412-6_22#, Abstract, 3 pgs.

Samanta, B., "Failure Analysis of Seal Lock Plates in Electric Submersible Pumps," Retreived on Jan. 24, 2017 from https://www.onepetro.org/conference-paper/SPE-81541-MS, Abstract, 3 pgs.

Cohen, D., "Captain Field Electric Submersible Pump, Condition Monitoring and Completion Systems," Retreived on Jan. 24, 2017 from https://www.onepetro.org/conference-paper/OTC-8510-MS, Abstract, 2 pgs.

* cited by examiner

NON-PARTING TOOL FOR USE IN SUBMERSIBLE PUMP SYSTEM

BACKGROUND

The production of hydrocarbons from an oil or gas well is often accomplished with an electrical submersible pump (ESP) system that includes multiple tools, such as one or more motors, pumps, gas separators, etc., in a linear, generally tubular configuration forming a tool string suitable for being lowered into a wellbore. The various tools are fixedly connected to each other at their ends such that, when the tool string is suspended vertically in the wellbore, each tool supports the weight of the tools therebelow. A shaft runs through the tool string along a longitudinal axis; this shaft may include separate shaft sections for each of the tools, which may be mechanically coupled together at their ends to transfer rotational motion from one section to the next.

During use of the ESP system to pump hydrocarbon fluids from the bottom of the well to the surface, the pumped fluid generally flows inside the tool string through flow passages contained in an annular region surrounding the shaft. The pumped fluid may be laden with an abrasive such as sand, which tends to cut into the tool housings. Continuous abrasion over a long period of time can ultimately result in the complete breaking of a tool into two parts. When that happens, the lower part of the tool as well as all tools suspended therefrom (hereinafter collectively referred to as the "lost unit") fall to the bottom of the well. In order to allow continued use of the well, a time-consuming and expensive "fishing job" is then usually undertaken to retrieve the lost unit. The fishing operation can take days or even weeks, and can cost on the order of a hundred thousand dollars. In some instances, the unit is irretrievable, and is shoved to the bottom of the well and abandoned. In the worst case, the well itself may be lost as a result, potentially causing economic damage of millions of dollars.

Figure 1:
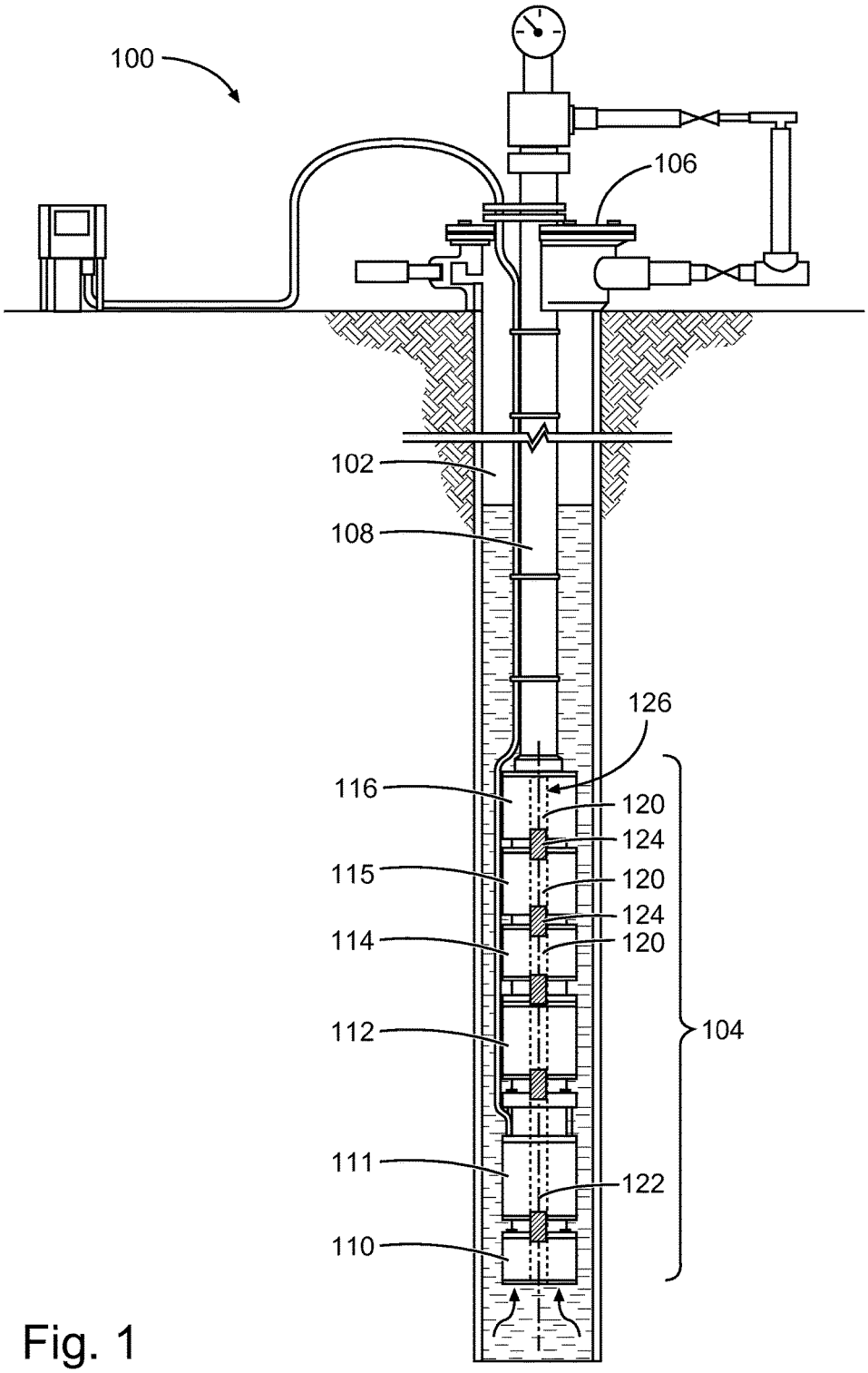
FIG. 1 is a diagram of an example ESP system in which a non-parting tool in accordance herewith can be used.

In the drawings, various shadings and hatchings are used to visually distinguish different components of the depicted tools. These shadings are not intended to indicate the types of materials used for the various components, and are, accordingly, not to be interpreted as limiting the scope of the depicted embodiments.

DETAILED DESCRIPTION

Disclosed herein are tool configurations that prevent the separation of a tool string into two disconnected units upon breaking of a tool within the tool string. The disclosed configurations are generally agnostic to the particular type and functionality of the tool, and thus applicable to any of the tools commonly used in an ESP tool string. (Further, although discussed in the context of ESP systems, various embodiments and features disclosed herein may be applicable to other systems as well.) Tools configured in accordance with the present disclosure are herein referred to as "non-parting." Beneficially, non-parting tools prevent the lower unit of a tool string that breaks at a location with the non-parting tool from falling to the bottom of the wellbore, thereby avoiding the need for an expensive fishing operation. As the breaking of tools due to persistent abrasion is sometimes unavoidable, employing non-parting tools can provide significant time and cost savings.

A non-parting tool in accordance with various embodiments includes two mechanical stops on the shaft at longitudinal locations within the head and the base of the tool, respectively. When the housing disposed between (and, in the intact state of the tool, connecting) the head and base breaks, these mechanical stops limit the amount by which the base can drop relative to the head, thereby preventing the separation of the tool. The stop in the head may be placed a short first distance above a first shaft support that is likewise located in the head, and may be sized or otherwise configured such that it cannot move (downward) past the first shaft support. As a result, the shaft can drop relative to the head by no more than the first distance. The stop in the base may be placed a second distance below a second shaft support located in the base, and may be sized or otherwise configured such that it cannot move (upward) past the second shaft support. As a result, the base can drop relative to the shaft by no more than the second distance. Collectively, the two stops limit the drop of the base relative to the head to the sum of the first and second distances. (In this disclosure, terms indicative of a vertical direction or relative vertical position, such as "upward," "downward," "drop," "above," "below," "upper," "lower," etc., are used with reference to the orientation in which tools and tool strings in accordance herewith are intended to be used when deployed in a vertical borehole. In this sense, the head of a tool is located above the base when the tool is properly used.)

FIG. 1 illustrates an example ESP system 100, in accordance with various embodiments, deployed in a cased wellbore 102. The ESP system 100 includes a tool string 104 suspended from a well head 106 by tubing 108. The string includes multiple individual tools that are fixedly attached to each other at their ends by threaded connections, bolts, or otherwise. Thus, each tool supports the weight of the tool string portion connected to the tool at its lower end (less any buoyancy forces resulting from (partial) submersion of the tool string in a fluid), and the tubing 108 supports the weight of the tool string 104 as a whole. As shown, the tool string 104 may include, for example, a sensor 110, motor 111, protector 112, gas separator 114, and two pumps 115, 116 (which may include a charger pump). As will be readily appreciated by one of ordinary skill in the art, an ESP system may generally include additional or different tools, or different tool arrangements, than depicted in FIG. 1.

The tools of the tool string 104 include shafts 120 arranged along a common longitudinal axis 122 and coupled together, via couplings 124, to form a contiguous shaft 126 (with multiple sections corresponding to the shafts of the individual tools) extending through the tool string 104. At its upper end, the shaft 126 may be fixedly mounted within or otherwise attached to the uppermost tool within the tool string 104. The couplings 124, in addition to causing each shaft (section) 120 to support the weight of all the shafts (or shaft sections) 120 below, serve to transfer rotational motion between the individual shafts (or shaft sections) 120. For instance, rotational shaft motion generated by the motor 111 may be imparted onto the shaft of the protector 112 by a coupling 124 connecting the shafts of the motor 111 and protector 112 to each other, and then further from the protector 112 all the way up to the pumps 114, 115. Shaft coupling may be reversible, i.e., the individual shafts 120 may be decoupled from each other, thereby preventing the transfer of rotational shaft motion from one tool to the next. This is important to prevent damage to the tools in case one of the tools breaks, as explained further below.

Figure 2A:
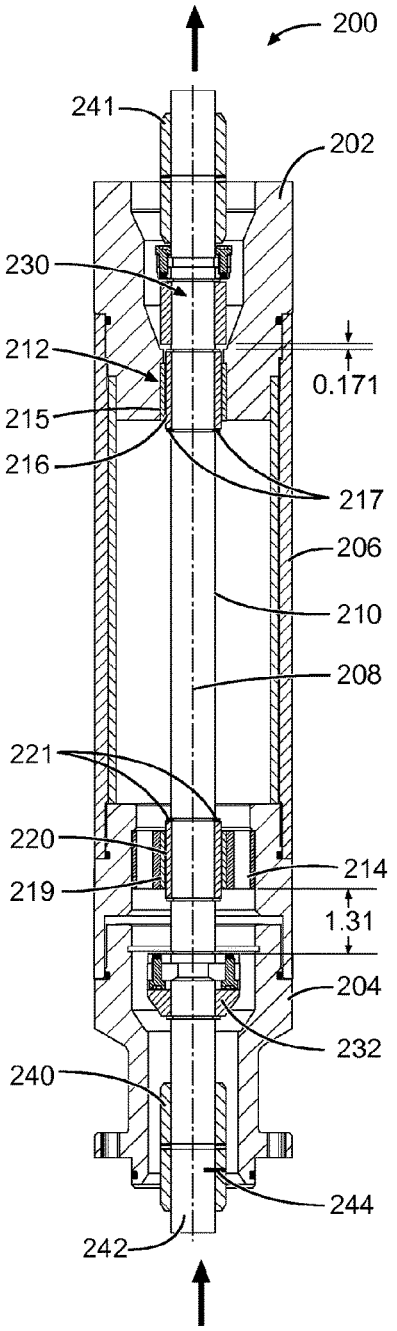
FIGS. 2A and 2B are cross-sectional views of a non-parting tool in accordance with various embodiments, showing the tool in the intact state and in the broken state, respectively.
Figure 2B:
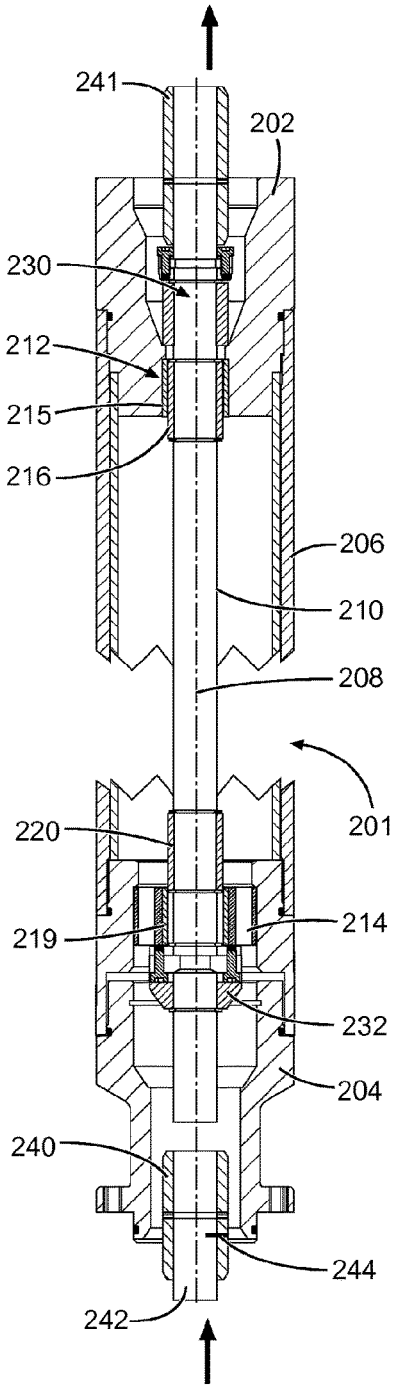

FIGS. 2A and 2B illustrate an example non-parting tool 200 in accordance with various embodiments in cross-sectional views. FIG. 2A shows the tool 200 in its intact state, whereas FIG. 2B shows the same tool in its broken state, the location of the break being indicated at 201. The salient features of the tool 200 are generic to various types of tools within a tool string 104, including, e.g., pumps, gas separators, or charger pumps. In various embodiments, multiple tools of a tool string 104 are configured as non-parting tools 200.

As shown, the tool 200 includes a head 202, a base 204, and a tubular housing 206 connected to the lower end of the head 202 and the upper end of the base 204 so as to fixedly connect the head 202 with the base 204. The housing 206 may, for example, be bolted onto the head 202 and base 204. Together, the head 202, housing 206, and base 204 form a tubular assembly that is, to a high degree, cylindrical about a longitudinal axis 208. An axial bore extends through this assembly along the longitudinal axis 208. A generally cylindrical shaft 210 is disposed within the axial bore, centered at the longitudinal axis 208, and held laterally in place by upper and lower shaft supports 212, 214 contained within the head 202 and base 204, respectively. The shaft 210 may be weakly secured in its longitudinal position relative to the assembly, e.g., by snap rings or similar structural components, so that the shaft 210 does not fall out during testing and field assembly of the tool string. However, these structural components generally break under the large forces they are subject to when the tool 200 breaks. ("Weakly secured" herein means that the shaft is secured against changes in its longitudinal position due to forces up to a certain maximum force, which is higher than the forces usually applied during testing and field assembly, but lower than typical forces resulting from breakage of the device.) Thus, for purposes of the present disclosure, the shaft 210 can be deemed generally movable relative to the head 202 and base 204 along the longitudinal axis 208. Further, the shaft 210 is rotatable relative to the assembly of head 202, housing 206, and base 204. The shaft 210 may be a solid cylindrical component, which, as shown in FIG. 2B, remains intact when the housing 206 of the tool 200 breaks. Thus, the shaft 210 can be used to hold the two parts of the tool 200 that result from breaking of the housing 206 together.

As shown, the upper shaft support 212 may be formed by an interior, axial constriction within the head 204 that is lined with a bushing 215 sized to accommodate the shaft 210. A sleeve 216 may be placed around the shaft 210 and held in place, e.g., with snap rings 217; the position of the sleeve 216 along the shaft 210 is generally such that, in a desired initial, intact state of the tool 200, the sleeve 216 is located inside the bushing 215. The lower shaft support 214 may be or include a thick, disk-shaped structure fixedly mounted or integrally formed with the base 204 and defining a central bore that accommodates the shaft 210, as well as one or more longitudinal passages that allow fluid flow through the shaft support 214. The central bore through the lower shaft support 214 may be lined with a bushing 219, and a sleeve 220 may be placed around the shaft 210 at a position aligned, in the desired initial, intact state of the tool 200, with the bushing 219. The sleeve 220 may be held in place with snap rings 221. When the shaft 210 moves relative to the head 202 and/or base 204 (as is generally the case after the housing 206 breaks), the sleeves 216, 220 tend to slide out of the respective bushings 215, 219; this is shown in FIG. 2B.

In accordance with various embodiments, the tool 200 includes two mechanical stops 230, 232 affixed to (or, in alternative implementations, integrally formed with) the shaft 210 at locations within the head 202 and base 204 of the tool 200, respectively. The stops 230, 232 extend at least partially around the circumference of the shaft 210, and, by virtue of extending radially beyond the shaft 210, provide mechanical obstacles to movement of the stops 230, 232 past the upper and lower shaft supports 212, 214, respectively. The upper stop 230 is placed above the upper shaft support 212, usually at a short distance (e.g., of less than an inch), such that, during a downward motion of the shaft 210 relative to the head 202 of the tool, the stop 230 hits a radially extending edge of the upper shaft support 212 (as shown in FIG. 2B) following a short fall, preventing any further downward motion of the shaft 210. In one example embodiment, the stop 230 is initially placed 0.171" above the upper shaft support 212, limiting the fall to 0.171". The lower stop 232 is placed below the lower shaft support 214 (usually at a distance greater than the initial distance between the upper stop 230 and the upper shaft support 212) such that, during a downward motion of the base 204 relative to the shaft 210, the shaft support 214 hits the lower stop 232 (as shown in FIG. 2B) after a fall by a certain distance, preventing any further downward motion of the base 204. The fall distance of the base 204 may be on the order of an inch; for example, in one embodiment, the fall distance, i.e., the initial distance between the lower shaft support 214 and the lower stop 232, is 1.31". The total fall distance of the base 204 relative to the head 202 is the sum of the fall distances of the shaft 210 relative to the head 202 and of the base 204 relative to the shaft 210, which is, in the example embodiment illustrated in FIG. 2B, a distance of 0.171"+1.31"=1.481". Of course, as will be readily appreciated by those of ordinary skill in the art, the specific fall distances and other dimensional details may vary depending on the specific product in which the mechanical stops are implemented.

The shaft 210 can be (and often is) coupled to the shafts of tools above and below the depicted tool 200 via couplings 240, 241. The couplings 240, 241 may be configured to slidably receive the ends of two shafts to be coupled. For example, as shown in FIG. 2A, the coupling 240 at the base 204 of tool 200 holds the lower end of the shaft 210 and the upper end of the shaft 242 of another tool (hereinafter referred to as the "intake" tool since fluid enters the tool 200 therefrom) immediately below. In the coupled state, the spacing between the two shaft ends is minimal. The shafts 210, 242 can be decoupled by pulling one or both shafts out of the coupling 240. This is illustrated in FIG. 2B, where the shaft 210 has been completely pulled out of the coupling 240. By contrast, in the depicted embodiment, the coupling 240 is pinned (e.g., via a pin 244) to the shaft 242 of the intake tool, preventing the shaft 242 of the intake tool from being pulled out of the coupling 240, so that the coupling 240 completely disengages from the shaft 210 of the tool 200.

In various embodiments, the initial distance between the lower stop 232 and the lower shaft support 214 is selected to be equal to or exceed the length of the coupling region between the shaft 210 and the coupling 240 (e.g., the length by which the shaft 210 extends into the coupling 240 in the fully coupled state) to ensure decoupling when the tool 200 breaks and the base 204 drops as a result. Decoupling may be desirable to stop rotational motion of the decoupled shaft, e.g., in circumstances where continued rotation could cause damage to the tool. For example, when the tool 200 breaks and the lower tool-string unit drops as a result, it is important that the rotation of shaft 210 stops and, therefore, that shaft 210 is decoupled from the lower unit (which usually includes the motor causing shaft rotation). Continued rotation of the shaft 210 for any extended amount of time may otherwise destroy the ability of the upper parts of tool 200 to hold the weight of the lower tool-string unit. (Upon breaking of a tool 200 within the tool string, the load on the motor drops, often resulting in a motor current I exceeding the applicable I-limit (also referred to as an under-load), and thus triggering a shut-down of the motor, thereby automatically stopping the rotation of the shaft 210. However, in many embodiments, the I-limit can be manually defeated. Automatic decoupling of the shaft 210 upon breaking of the tool 200 may serve as an additional mechanism, independent of the I-limit, ensuring that rotation of the shaft 210 discontinues.)

Figure 3A:
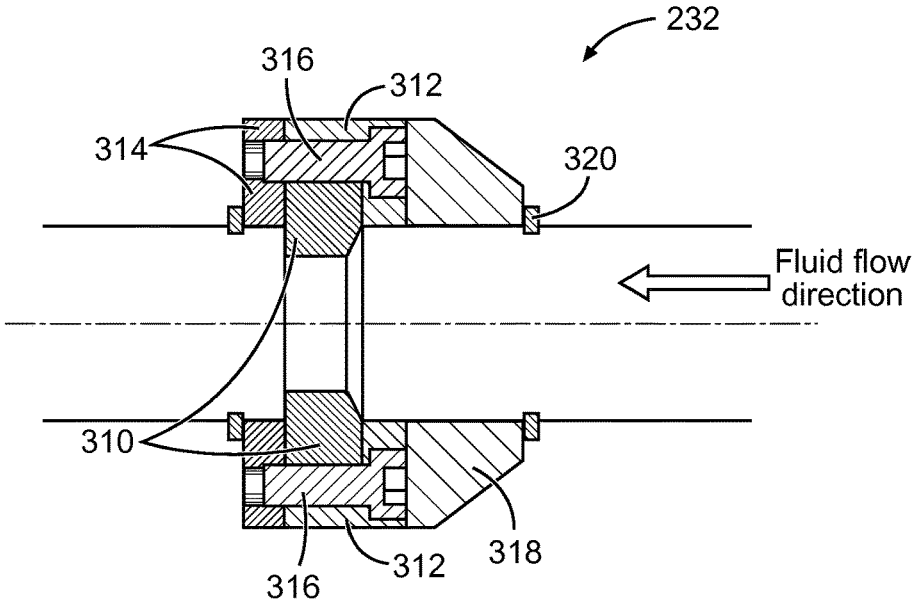
FIGS. 3A and 3B are cross-sectional views of example upper and lower stops, respectively, in accordance with various embodiments.
Figure 3B:
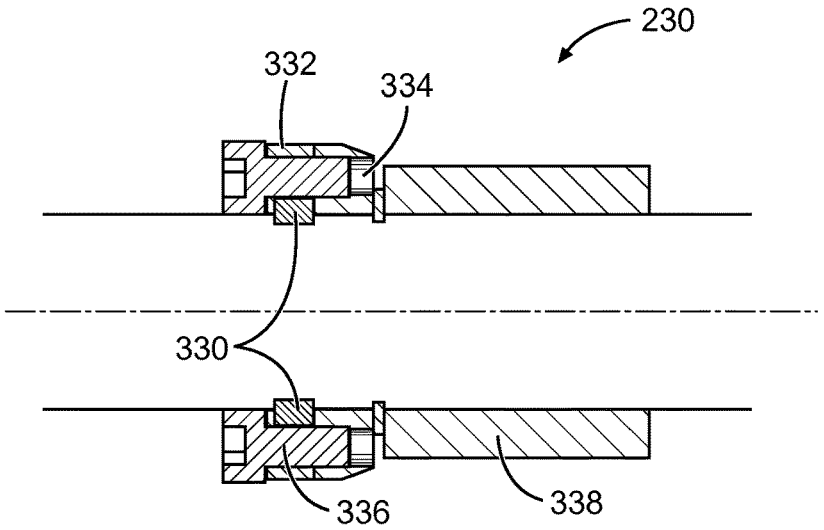

Referring now to FIGS. 3A and 3B, example embodiments of the stops 232, 230 are illustrated in more detail. As shown in FIG. 3A, the lower stop 232 may include a two-piece ring 310 (e.g., including two half-circular ring segments) seated in a complementary groove formed circumferentially in the shaft 210. The ring 310 is securely retained between a retaining ring 312 and a retaining-ring back-plate 314, which held together by screws 316; in this manner, the two-piece ring 310 is prevented from coming lose or moving. A fluid diverter 318 may be included to prevent sand or solids contained in the fluid from impinging against and thereby potentially compromising the other components of the stop 232. The fluid diverter 318 may be held in place by a snap ring 320. As shown in FIG. 3B, the upper stop 230 may be structurally and functionally very similar, although the dimensions of the various stop components may vary significantly from those of the lower stop 232, and the upper stop 230 generally does not include a fluid diverter. Specifically, the upper stop 230 may include a two-piece ring 330 retained between a retaining ring 332 and a back-plate 334 held together by screws 336. The back-plate 334 may be extended by a sleeve 338 fixedly attached thereto, which is designed to hit against the upper shaft support 212.

In various embodiments, the ring 310 of the lower stop 232 (and often also the ring 330 of the upper stop) is made of Monel™ material (a nickel-copper-based alloy) (e.g., Monel™ K500 material) or Inconel™ material (a nickel-chromium-based alloy) (e.g., Incone™I 718 material), both of which have high tensile strength and are highly corrosion-resistant (and thus suitable for use in high-temperature and high-pressure environments, such as in a borehole). When the lower shaft support 213 hits the lower stop 232 upon breaking of the housing 206, both the ring 310 and the groove are subjected to significant shear forces resulting from the impact. For a given tool string, the maximum expected impact force can be computed straightforwardly from the drop distance of the base 204 relative to the shaft 210 and the total weight of the lower tool-string unit (or, to use an upper boundary for the weight, from the total weight of the tool string). In various embodiments, the ring 310 is configured to sustain, without breaking, shear forces of at least twice (and, in some embodiments, four times or even ten times) the maximum expected impact force. Similarly, the shaft and groove may be configured to sustain, without substantial deformation (e.g., without changes to the orientation of the grove in excess of ten degrees or changes to the groove dimension in excess of ten percent), shear forces at least twice (and, in some embodiments, four times or more) the maximum expected impact force. For commonly used tool strings having a total weight not exceeding, e.g., four tons and a drop distance not exceeding 1.5", such safety ratios of at least 2 can be achieved using a ring 310 made, e.g., of Monel™ K500 material or Inconel™ 718 material that has suitable dimensions (e.g., in accordance with various embodiments, a thickness of about 0.25", and a ring-extrusion distance into the shaft 210 of about 0.1", and an inner ring diameter of about 0.7") and a shaft made, e.g., of Inconel 718.

Figure 4:
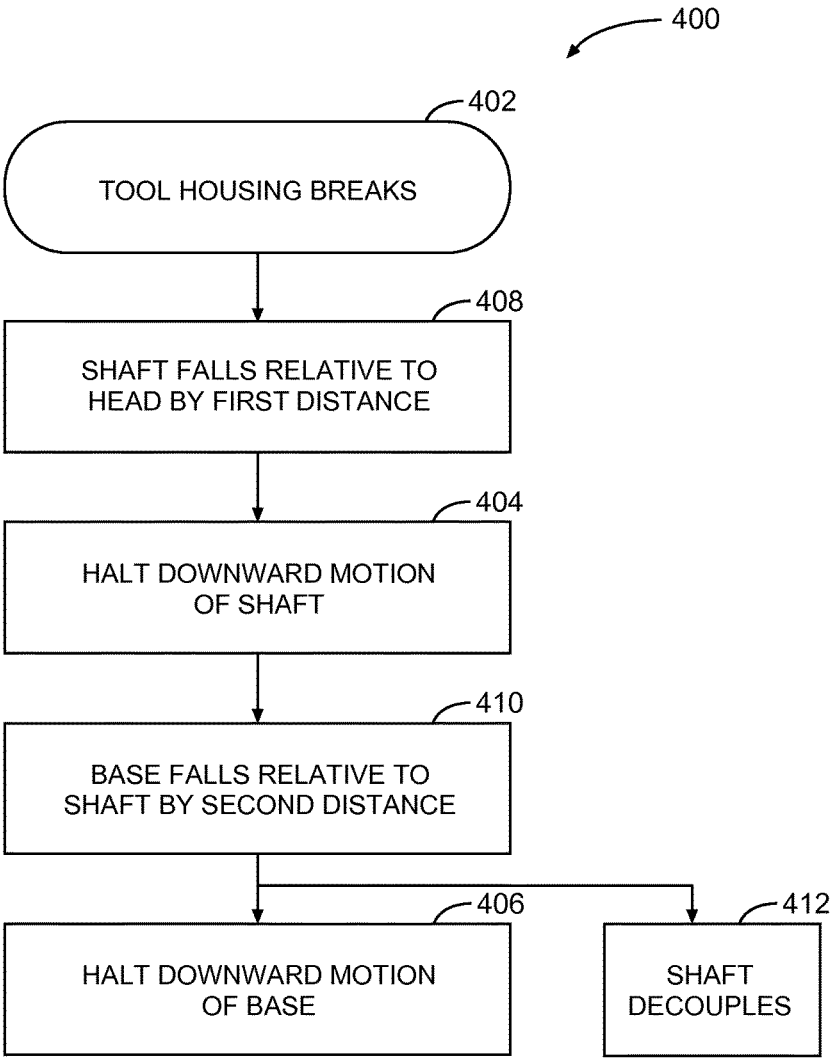
FIG. 4 is a flow chart illustrating a method of operation of non-parting tools in accordance herewith.

FIG. 4 is a flow chart illustrating a method 400 of operation, in accordance with various embodiments, of a non-parting tool deployed in a borehole (e.g., as part of an ESP system). The method 400 prevents longitudinal separation, upon breaking of the housing (indicated at 402), between the head and base by more than a specified distance by halting downward motion of the tool shaft relative to the head with a first stop fixedly mounted to the shaft (404) and halting downward motion of the base relative to the shaft with a second stop fixedly mounted to the shaft (406). In some embodiments, after the shaft (and with it the base and all other components attached thereto below) has fallen relative to the head by a first distance (408), the first stop hits a first shaft support disposed in the head of the tool, which precludes further downward motion of the shaft. Similarly, after the base has fallen relative to the shaft by a second distance (410), the second stop hits a second shaft support disposed in a base of the tool, which precludes further downward motion of the base. The first and second stops may be configured such that they sustain the forces resulting from the impact between the stops and the respective shaft supports (such as, in embodiments where the stops contain rings secured in complementary grooves in the shaft, shear forces acting upon the rings and/or grooves). The method 400 may further include decoupling the shaft at a lower end thereof from a second shaft to which it may initially be coupled (such as the shaft of an intake tool below) (412). The second shaft may be held in a fixed position relative to the base such that decoupling is accomplished through the fall of the base relative to the shaft by the second distance.

Various embodiments have been described above with reference to specific details. As will be readily apparent to those of ordinary skill in the art, however, many different embodiments, with different features and characteristics, can be implemented using the general concepts described herein. For example, many alternative structures of the mechanical stops, using different materials, dimensions, or sub-components, will occur to those of ordinary skill in the art. Further, many non-parting tools operating generally in the manner described above may be implemented using different dimensions and details than those used in the depicted embodiments. Accordingly, the embodiments described herein are intended as merely illustrative, and not as limiting the scope of the claimed subject matter.

What is claimed is:

1. A tool comprising:

a cylindrical assembly comprising, disposed along a longitudinal axis thereof, a head containing an upper shaft support, a base containing a lower shaft support, and a housing disposed between and fixedly connecting the head and the base, the assembly defining therethrough an axial bore about its longitudinal axis;

a first shaft disposed within the axial bore and mounted in the lower and upper shaft supports;

a first stop fixedly attached to the first shaft, the first stop being located inside the head initially at a first distance above the upper shaft support and configured to prevent motion past the upper shaft support;

a second stop fixedly attached to the first shaft, the second stop being located inside the base initially at a second distance below the lower shaft support and configured to prevent motion of the second stop past the lower shaft support, wherein, upon breaking of the housing, the first and second stops are configured to collectively prevent longitudinal separation of the head and the base by more than a sum of the first distance and the second distance, and a second shaft coupled, via a coupler, to a lower end of the first shaft, wherein a first length of the lower end of the first shaft is within the coupler, and the second distance equals or exceeds the first length such that the first shaft is configured to exit the coupler and decouple from the second shaft upon the base portion moving at least the second distance relative to the head and wherein the second shaft remains within the coupler.

2. The tool of claim 1, wherein the first shaft is rotatable relative to the assembly.

3. The tool of claim 1, wherein the first shaft is weakly secured in its longitudinal position relative to the assembly, but longitudinally movable relative to the assembly upon breaking of the housing.

4. The tool of claim 1, wherein the second stop comprises a two-piece ring secured in a groove formed in the first shaft.

5. The tool of claim 4, wherein the ring is configured to sustain shear forces of at least twice a maximum impact force resulting from breaking of the housing.

6. The tool of claim 5, wherein the two-piece ring comprises Monel™ material or Inconel™ material.

7. The tool of claim 4, wherein the groove is configured to sustain, without deformation, shear forces of at least twice a maximum impact force resulting from breaking of the housing.

8. The tool of claim 4, wherein the shaft comprises Inconel™ material.

9. A submersible pump system comprising:

a tool string comprising a plurality of tools fixedly connected to each other in a linear arrangement, the tool string defining therethrough a contiguous axial bore about a longitudinal axis, each tool comprising a shaft disposed within the axial bore and rotatable relative to the tool, the shafts of the plurality of tools being connected to each other via couplings configured to impart rotation of a first shaft to a second shaft connected thereto, wherein at least one of the tools comprises:

a head, a housing, and a base disposed along the longitudinal axis, the housing fixedly connecting the head to the base, the first shaft of the tool being mounted in an upper shaft support of the head and a lower shaft support of the base;

first and second stops fixedly attached to the first shaft, the first stop being located inside the head and the second stop being located inside the base;

the second shaft coupled via a coupler to a lower end of the first shaft wherein a first length of the lower end of the first shaft is within the coupler;

wherein the first shaft is configured to be longitudinally movable relative to the head and base, and wherein the first stop is configured to prevent further movement of the first shaft relative to the head upon contact with the upper shaft support and the second stop is configured to prevent further movement of the first shaft relative to the base upon contact with the lower shaft support; and wherein an initial distance between the second stop and the lower shaft support is equal to or exceeds the first length, such that, the first shaft is configured to exit the coupler and decouple from the second shaft upon the base moving at least the initial distance relative to the head.

10. The system of claim 9, wherein the tool string comprises a motor disposed below the tool comprising the stops, whereby decoupling between the first and second shafts prevents rotational motion imparted by the motor on the second shaft from being imparted on the first shaft of the tool comprising the stops.

11. The system of claim 9, wherein the tool comprising the stops is one of a pump or a gas separator.

12. The system of claim 9, wherein the first and second stops are configured to sustain impact forces in excess of an impact force resulting from impact of an object having a weight of the tool string following a free fall over a distance corresponding to a drop distance between the first shaft and base.

13. The system of claim 9, wherein a plurality of the tools comprise first and second stops located inside head and base portions of the tool, respectively.

14. A method for preventing separation of a tool used in a submersible pump system deployed in a borehole, the tool comprising a head, a base, and a housing disposed between and fixedly connecting the head and the base, and a shaft disposed within an axial bore through the tool, the method comprising:

breaking of the housing, halting downward motion of the shaft relative to the head with a first stop fixedly mounted to the shaft;

halting downward motion of the base relative to the shaft with a second stop fixedly mounted to the shaft, whereby longitudinal separation of the head and the base by more than a specified distance is prevented; and decoupling a lower end of the shaft from a second shaft having a fixed longitudinal position relative to the base.

15. The method of claim 14, wherein motion of the shaft relative to the head is halted following a fall of the shaft by a first distance upon contact of the first stop with an upper shaft support disposed in the head.

16. The method of claim 14, wherein motion of the base relative to the shaft is halted following a fall of the base by a second distance upon contact of the second stop with a lower shaft support disposed in the base.

17. The method of claim 14, wherein halting the downward motion comprises sustaining shear forces acting on the stops upon an impact between the stops with shaft supports disposed in the head and base.

* * * * *